US005862809A

United States Patent [19]

Nicotra

[11] Patent Number: 5,862,809

[45] Date of Patent: Jan. 26, 1999

[54] CIGAR HOLDER WITH SNUFFER

[75] Inventor: Dennis P. Nicotra, Woodbridge, Conn.

[73] Assignee: Cigar Savor Enterprises LLC, Woodbridge, Conn.

[21] Appl. No.: 868,602

[22] Filed: Jun. 4, 1997

[51] Int. Cl.[6] ..... A24F 15/08

[52] U.S. Cl. ..... 131/256; 131/254

[58] Field of Search ..... 131/256, 254, 131/233, 238

[56] References Cited

U.S. PATENT DOCUMENTS

| | | | |
|---|---|---|---|
| 450,312 | 4/1891 | Hieatzman | 131/256 |
| 802,300 | 10/1905 | MacLachlan | 131/256 |
| 1,764,862 | 6/1930 | Vogelsang | 131/256 |
| 3,173,641 | 3/1965 | Dorrance | 131/256 |
| 3,978,981 | 9/1976 | Musick | 131/256 |
| 4,777,968 | 10/1988 | Beloff | 131/256 |
| 4,907,604 | 3/1990 | Beloff | 131/256 |

FOREIGN PATENT DOCUMENTS

| | | | |
|---|---|---|---|
| 212485 | 11/1940 | Switzerland | 131/256 |
| 248289 | 4/1947 | Switzerland | 131/256 |
| 447501 | 11/1967 | Switzerland | 131/256 |

*Primary Examiner*—John G. Weiss
*Assistant Examiner*—Charles W. Anderson
*Attorney, Agent, or Firm*—DeLio & Peterson, LLC

[57] ABSTRACT

A portable cigar holder for rapidly extinguishing a lighted cigar and for saving the extinguished cigar for later consumption is provided. The cigar holder comprises a hollow cylindrical tube having a closed end portion and an open end opposed to said closed end portion and a removable cap sized to close the open end of the tube for forming a substantially air tight container so as to promote rapid extinguishing of the lighted cigar. The cigar holder includes a specially configured snuffer which snuffer is in the shape of a bowl with the open end of the bowl facing the open end of the cigar holder and which snuffer is readily slideable within the cigar holder. The cigar holder of the invention accommodates cigars of different lengths while minimizing the overall length of the cigar holder so that the holder may be comfortably carried by the cigar smoker. The snuffer is preferably connected to the upper end of spring means at a point above the base of the snuffer and the snuffer is configured so that when the snuffer is moved downward in the tube when a cigar is inserted in the holder the lower portion of the snuffer is disposed (nested) within the spring means and the overall length of the cigar holder needed is shorter than prior art cigar holders for holding the same length cigars.

13 Claims, 1 Drawing Sheet

CIGAR HOLDER WITH SNUFFER

BACKGROUND OF THE INVENTION

1. Field of the Invention

The present invention relates to a cigar holder device for rapidly extinguishing a lighted cigar and saving it for later consumption, and, more particularly, to an improved snuffer device readily slideably engaged within the cigar holder which snuffer enables the cigar holder device to accommodate cigars of longer lengths than previous cigar holders of the same overall dimensions.

2. Description of Related Art

Cigar smokers, because of the length of time required to smoke an entire cigar, often need to extinguish a cigar before it is completely consumed. As more and more public facilities become designated non-smoking sites, this problem becomes even more pronounced. Devices for extinguishing lighted smoking materials and/or saving them are known in the art.

U.S. Pat. No. 1,764,862 to Vogelsang illustrates a portable cigar or cigarette extinguisher comprising a hollow member having a cylindrical bore for receiving the cigar. U.S. Pat. No. 3,173,641 to Dorrance illustrates an ash tray and snuffer device. The Dorrance device comprises a hollow receptacle open at one end and closed at the other which is mounted to a base by a wire support structure. U.S. Pat. No. 802,300 to Maclachlan illustrates another cigar extinguisher and retention device. The Maclachlan device comprises a hollow, conical cap and an elastic tube for covering the extinguished cigar. U.S. Pat. No. 450,312 to Hieatzman illustrates a closed case for extinguishing and preserving a cigar. The Hieatzman device comprises a base portion having a blade type device for cutting off the burning portion of the lighted cigar. The base portion includes a hollow portion for receiving the cigar. The device further includes a telescopic portion which fits into the hollow portion to form a sealed container.

Another type of cigar holder is illustrated in U.S. Pat. No. 3,978,981 to Musick. This device differs from the other devices in that it is not intended to be used as a cigar extinguisher. The Musick device comprises a receptacle for receiving the lighted end of the cigar and a separate cap for receiving the wet end of the cigar. The receptacle has a mesh venting screen to permit the cigar to burn. As a result of this construction, this type of device could not easily be carried in a pocket of a user.

Still other types of holders for lighted tobacco products are illustrated in Swiss Pat Nos. 212,845 and 248,289. The device in the '845 patent uses a spring operated snuffer to help extinguish the cigar or cigarette. It lacks, however, a cap for creating sufficient pressure to substantially instantaneously extinguish the cigar or cigarette.

In U.S. Pat. Nos. 4,777,968 and 4,907,604, both of which are owned by the assignee of the present invention, cigar holders for rapidly extinguishing a lighted cigar and saving the extinguished cigar for later consumption are shown. In the '968 patent, the cigar holder comprises a hollow cylindrical tube having a closed end, an open end, and an end cap for sealing the open end to form a substantially air tight container. A spring controlled snuffer is positioned within the tube and adapted for movement relative to the tube. In the '604 patent, a similar cigar holder is shown having an improved end cap which is configured to receive and reshape an unlit, wetted tip of the extinguished cigar and a pin having a pointed end for punching a hole in the unlit cigar tip.

Bearing in mind the problems and deficiencies of the prior art, it is therefore an object of the present invention to provide an improved device for extinguishing and saving a cigar.

It is a further object of the present invention to provide a device as above which will accommodate cigars of longer lengths than other devices while still maintaining the same overall length of prior art devices.

It is yet a further object of the present invention to provide a device as above which will extinguish a cigar and not adversely affect the taste of the cigar.

It is still a further object of the present invention to provide a device as above which may be carried within the pocket of the user's apparel.

Other objects and advantages of the present invention will be readily apparent from the following description and drawings in which like references numerals depict like elements.

SUMMARY OF THE INVENTION

The above and other objects, which will be apparent to those skilled in the art, are achieved in the present invention which is directed in a first aspect to a device for rapidly extinguishing a lighted cigar and for saving the extinguished cigar for later consumption with the device having an overall length which is convenient for the cigar smoker to use and carry and accommodating cigars of longer lengths than prior art devices of the same overall length. The device comprises a hollow cylindrical tube having a closed end portion, an open end opposed to the closed end portion, adjusting means, preferably spring means, snuffer means which moves within the tube toward the closed end portion when a cigar is inserted into the device and wherein the lower portion of the snuffer means is positioned below the upper end of the adjusting means and nests within the adjusting means, and a removable cap for sealing the open end to form with the tube a substantially airtight container for rapidly extinguishing the lighted cigar. The snuffer means is of a bowl shape and is preferably in the shape of a truncated cone having a bore and an open wider upper end and a closed narrower lower end with the snuffer being secured to the adjusting means at a point above the base of the snuffer cap. When the cigar is pushed into the cigar holder, the snuffer is pushed downward in the tube and when the cigar is totally in the tube and the end cap secured, the lower portion of the snuffer is below the upper end of the adjusting means thus minimizing the length of the cigar holder needed for any particular length cigar.

The removable cap preferably has a bore for receiving the normally flattened, unlit, wetted tip of the cigar and is shaped or configured to reform the tip of the cigar into a desired shape. In addition, the cap is also preferably provided with an axially centrally positioned pin having a pointed end. The pin punches a hole in the reformed cigar tip so that upon removal of the cigar from the device, a user need only light a match to continue smoking the cigar.

It has been found that the device of the present invention also enables a lighted cigar to be extinguished substantially instantaneously. As a result, the taste of the cigar is not adversely affected and, the moisture in the tip is locked in the device and thus the cigar is kept substantially humidor-fresh. In addition, there is no significant heat build-up in the device.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
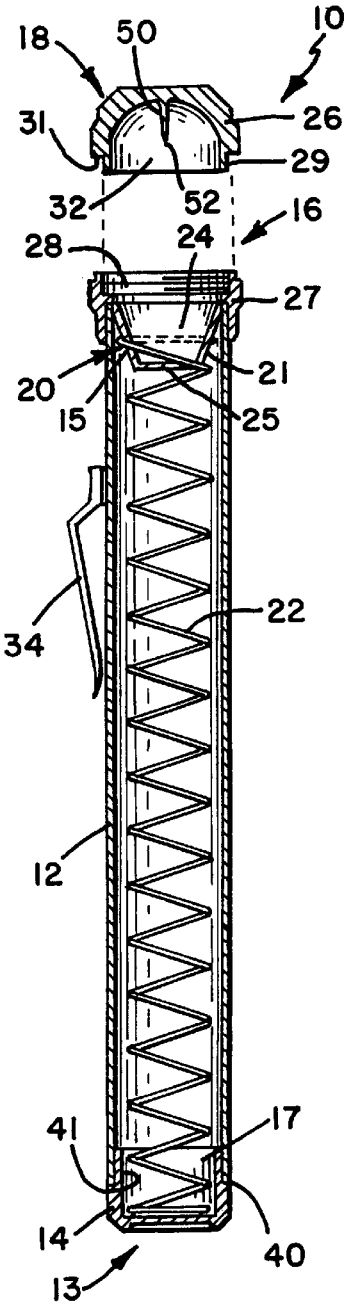
FIG. 1 is a cross sectional view of a cigar extinguishing and preserving device of the present invention.

In describing the preferred embodiment of the present invention, reference will be made herein to FIGS. 1–3 of the drawings in which like numerals refer to like features of the invention. Features of the invention are not necessarily shown to scale in the drawings.

The device of the present invention rapidly extinguishes a lighted cigar for later consumption and the cigar is extinguished substantially instantaneously which is desirable both from the standpoint of preventing heat build-up and from the standpoint of retaining a cigar's taste. A preferred device is further designed to reshape the normally flattened, unlit tip of the cigar and to prevent the transfer of unsightly tobacco juices and smoke odors to the user's apparel.

It is an important aspect of the invention that the device accommodate cigars of different lengths and diameters while still maintaining the overall length of the device at a length for any particular cigar which is less than the length required for prior art cigar holder devices.

Referring now to the figures, the device shown generally as 10 comprises a hollow cylindrical tube 12 having a closed end 13 and an open end 16. The tube 12 may have any desired length and any desired inner and outer diameters. Preferably, the tube is of a size sufficient to permit the accommodation of cigars of different lengths and diameters and it is an important feature of the invention that the length of the cigar holder is shorter than prior art cigar holders for holding the same length cigars.

The tube 12 is formed from a material which is highly resistant to impact in order to fully protect the cigar. In view of the fact that the device will initially contain a lighted cigar, the tube material is also substantially non-combustible and has a relatively high melting point. Suitable materials for the tube include but are not limited to plastics such as polypropylene, polyethylene, polycarbonate and nylon. If desired, the tube 12 could be formed from a metal or metal alloy which does not transmit significant amounts of heat to the user.

The closed end 13 of the tube 12 is preferably formed by a removable, substantially cylindrical, solid end cap 14 inserted by a force fit within an opening 17 in the tube and made from the same material as the tube 12. A removable end cap is useful in removing ashes from the interior of the tube and/or servicing internal components such as spring 22. The end cap 14 may also be secured to the tube 12 in any desired manner. For example, the end cap 14 may be fixedly secured to the tube 12 by an adhesive. If desired, threads or a slot may be provided in the end cap 14 and the end portion of tube 12 to facilitate removal of the end cap from the tube or attachment of the end cap to the tube. In a preferred embodiment as shown, the end cap 14 has a lip portion 40 which abuts against an end wall of the tube 12 and an extension 41 which force fits within tube 12. The lip portion insures proper positioning of the cap 14 relative to the tube 12 and helps form a good airtight seal. In lieu of a removable or fixedly secured end cap, the device 10 could comprise a tube 12 having an integrally closed end portion.

To seal the open end 16 of the tube, a substantially cylindrical, removable top cap 18 is provided. When properly positioned, the top cap 18 forms with the tube 12 a substantially airtight container. The top cap 18 may be sized to snugly fit within the end of the tube or fit over the tube and be secured to the tube by threads or other fastening means such as a flange and slot as shown in U.S. Pat. No. 4,777,968, supra. A friction fit may also be acceptable for some cigar holder devices. Preferably, a sleeve 27 is secured to the upper edge of tube 12. The sleeve has an inner opening 28 which is threaded. Top cap 18 is configured to fit within opening 28 and has external threads 29 to allow securing the top cap 18 to the threads and tube 12. To insure the formation of a good seal between the top cap 18 and the tube 12, an integrally formed lip 31 is provided for abutting against the upper portion of sleeve 27. The locking means is preferably a threaded connection as shown but may also comprise a substantially L-shaped slot in the sleeve 27 and a flange preferably formed as an integral part of the cap wherein the flange is inserted into the slot and the cap is rotated until the flange is locked. The top cap 18 may be formed from any suitable material known in the art. Preferably, the top cap 18 is formed from the same material as tube 12 and end cap 14.

The top cap 18 comprises a cylindrically shaped member 26 having a bore 32 for receiving the normally flattened, unlit, wetted tip of the cigar. During smoking, many cigar smokers chew on the tip of the cigar causing it to acquire a flattened appearance. The bore 32 preferably has a shape or configuration similar to that of a truncated cone or semi-circular which reshapes the unlit cigar tip and substantially restores the taper to the cigar tip. In addition, the top cap 18 has a punch pin 50 with a pointed end 52. Ideally, the pin 50 is positioned centrally within the bore. When the cap is placed over the end of a cigar, the pin 50 punches a hole in the cigar tip. Later when the cigar is removed for further smoking, a user does not have to bite the tip or use a separate tool to punch a hole in the tip. The pin 50 may be mounted to the cap 18 in any suitable manner.

A snuffer 20 is provided within the tube 12 for extinguishing the cigar. The snuffer 20 is generally in the shape of a bowl with the open end of the bowl facing the open end 16 of tube 12. The snuffer preferably comprises, as shown, a closed ended truncated cone member 21 having a base 25 and a bore 24 for receiving the lighted end of the cigar. Preferably, the bore 24 follows the shape of the snuffer and in this case is in the shape of a truncated cone. The bore 24 of the truncated cone receives a cigar and the snuffer 20 is sized to permit relative sliding movement between the snuffer and the tube. By providing such an arrangement, cigars of different lengths can be accommodated. A spring 22 such as a helical spring is provided within the tube 12 to restore the snuffer 20 to a desired initial position shown at the upper end of tube 12 in FIG. 1. The spring 22 is preferably fixedly secured at its upper end to the snuffer 20 at a point intermediate the height of the snuffer. The lower end of spring 22 may be secured to the end cap 14 or at or near the lower end of the end cap. Alternatively, the lower end of spring 22 may rest at the base of end cap 14. Grooves 15 may be provided in the snuffer 20 for locking the spring 22 in place.

When the top cap 18 is placed over the end of a cigar and locked in position the cap forces the lighted cigar in the open end 24 of snuffer 20 and against the base 25 of the snuffer 20. This helps create sufficient pressure that the lighted cigar is substantially instantaneously extinguished.

While the snuffer 20 may be formed from any desired material, it is preferably formed from a thermally conductive metal such as aluminum or a metal alloy. The use of a metallic snuffer is desirable for permitting heat from the lighted end of the cigar to be dissipated.

To permit the device to be worn in a pocket of the user's apparel, a clip 34 is provided. The clip 34 may comprise any suitable clip device known in the art. For example, the clip 34 may be a slideable clip having a portion for overlapping the user's pocket and an integral ring element 36 as shown in FIG. 3 substantially surrounding the outer periphery or exterior of the tube 12. Such a clip 34 is useful because it permits the device 10 to be used with different sized pockets. Alternatively, the clip could be an integral part of the tube 12.

Figure 2:
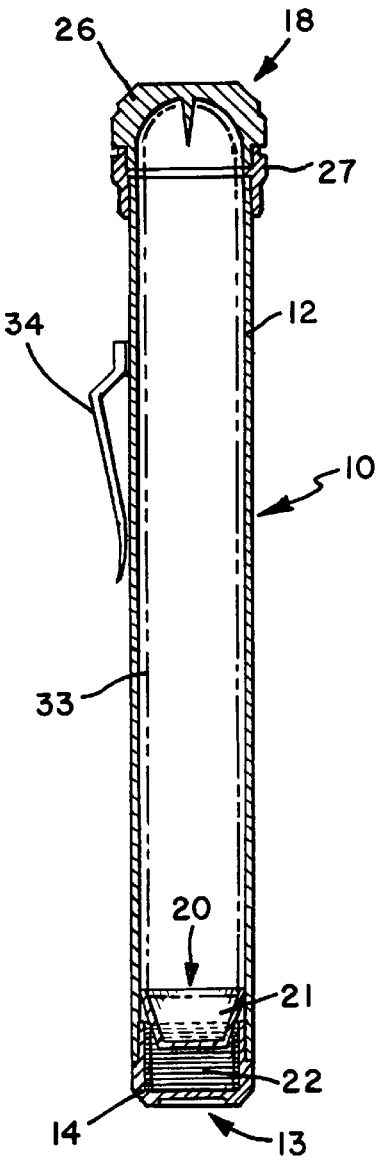
FIG. 2 is a is a cross sectional view illustrating a cigar housed within the device of FIG. 1 wherein the length of the cigar is essentially the overall inner length of the device.

The device 10 is used by inserting the lighted end of a cigar 11 as shown in FIG. 2 into the tube 12 until it contacts the bottom 25 of the bore 24 in the snuffer cap 20. The top cap 18 is placed over the unlit end of the cigar and is used to push the cigar towards the closed end 17 of the tube. This causes the snuffer 20 to move towards the closed end 17 of the device 10 and the spring 22 to become compressed. The top cap 18 is inserted into the open end 16 of tube 12 and sleeve 27 and the cap 18 is then rotated until in its locked position. Since the top cap 18 forms a substantially airtight container with the tube 12, the cigar is rapidly extinguished. The bore 32 in the top cap 28 meanwhile reshapes the unlit tip of the cigar while the pin 50 punches a hole in the tip.

When the user wishes to smoke the cigar again, the top cap 18 is rotated until in its unlocked position. The top cap 18 is then removed from the tube 12. The spring 22 causes the cigar 11 to extend outwardly of the tube 12. Ultimately, the spring restores the snuffer 20 to its initial position shown at the upper end of tube 12.

Referring to FIG. 2, it can be seen how the lower portion of truncated cone member 21 of snuffer 20 is nested in compressed spring 22 when cigar 33 is placed in the device. This nesting decreases the overall length of the cigar device needed to accommodate cigars of the same length and is more convenient for the user of the cigar to extinguish because of its increased stability, and to save and transport the cigar because of its shorter overall length compared to prior art devices.

The snuffer cap 20 may also have other designs wherein the lower portion of the cap nests within the adjusting means, preferably spring means. Thus, a cylindrical cap having a wider upper end and a narrower lower end may suitably be employed. Likewise, a cylindrical cap may have an upper outwardly extending lip for engaging the adjusting means with the major portion of the cap nesting in the adjusting means. Such a lip can also be used with the truncated cone design described hereinabove or other such suitable snuffer means.

While the device of the present invention is designed to extinguish lighted cigars, it may also be used to store a new cigar. The device will prevent the cigar from breaking and will keep it fresh. The pin in the cap will poke a hole in the end of the cigar so that upon removal of the cigar, the user need only light a match to start smoking.

Figure 3:
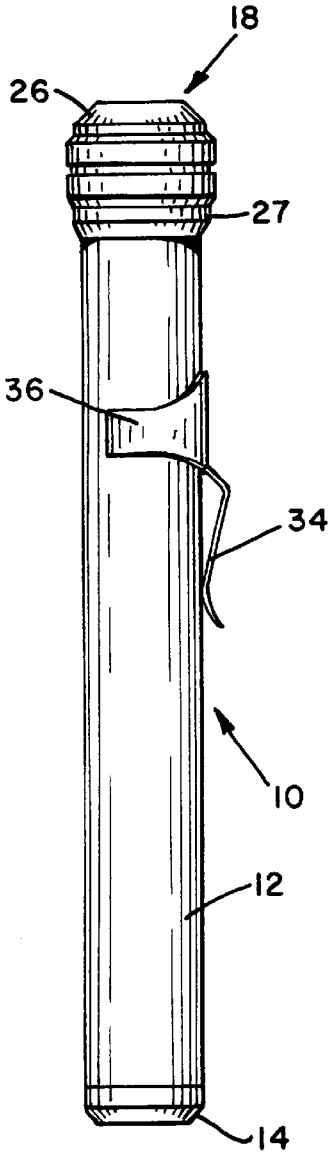
FIG. 3 is a front elevational view of a cigar holder of the invention.

FIG.3 shows a front elevational view of the cigar holder in its closed position.

It is apparent that there has been provided in accordance with this invention a device for extinguishing and for saving cigars which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

Thus, having described the invention, what is claimed is:

1. A device for rapidly extinguishing a lighted cigar and for saving said extinguished cigar for later consumption which comprises:

a hollow cylindrical tube having a closed end portion and an open end portion opposed thereto;

a first removable cap adapted to cooperate with said open end portion for sealing the open end so as to form a substantially airtight container and thereby promote rapid extinguishment of said lighted cigar;

snuffing means for snuffing a lighted cigar positioned within said tube, said snuffing means being adapted to move relative to said tube to accommodate cigars of different lengths and having a closed base and a bore therein which bore is open to the open end portion of the tube to receive the lighted end of teh cigar; and adjusting means within the tube for moving the snuffing means within the tube, the adjusting means having a lower end and an upper end with the lower end proximate the closed end portion of the tube and the upper end contacting said snuffing means at a point above the base of the snuffing means wherein the base and portion of the snuffing means below the point of contact of the adjusting means nests within the adjusting means in both the position when there is no cigar within the device and when a cigar is positioned within the device so as to accommodate cigars of different lengths in the device while minimizing the overall length of the device.

2. A device according to claim 1 wherein said snuffing means is formed by a truncated cone shaped member having a bore therein to receive the lighted end of said cigar.

3. A device according to claim 2 wherein the bore is in the shape of a truncated cone.

4. A device according to claim 3 wherein said snuffing means is formed from a thermally conductive material and said tube and said cap are each formed from a substantially impact resistant, substantially non-combustible material.

5. A device according to claim 4 wherein said snuffing means is formed from aluminum or an aluminum alloy and said tube and cap are formed from a plastic material.

6. A device according to claim 1 which further comprises means for permitting said device to be clipped to a user's apparel.

7. A device according to claim 1 wherein said snuffing means is cylindrical.

8. A device according to claim 7 wherein the cylindrical snuffing means has a wider upper portion and a narrower lower portion, which lower portion nests within the adjusting means.

9. A device according to claim 7 wherein the cylindrical snuffing means has an outwardly extending upper lip.

10. A device according to claim 1 wherein the closed end portion is formed using a removable end cap.

11. A device according to claim 1 wherein the adjusting means is a spring.

12. In a device for rapidly extinguishing a lighted cigar and for saving said extinguished cigar for later consumption which comprises a hollow cylindrical tube having a closed end portion and an open end portion opposed thereto, a first removable cap adapted to cooperate with said open end portion for sealing the open end so as to form a substantially air tight container and thereby promote rapid extinguishment of said lighted cigar, snuffing means for snuffing a lighted cigar the snuffing means positioned within the tube and being adapted to move relative to said tube to accommodate cigars of different lengths and adjusting means within the tube for moving the snuffing means within the tube and which contacts the snuffing means, the improvement comprising:

the snuffing a closed base and a bore therein which is open to the open end portion of the tube and which snuffing means is configured to nest within the adjusting means so that both the base of the snuffing means and the portion of the snuffing means below the point of contact with the adjusting means is below the upper portion of the adjusting means in both the position when there is no cigar in the device and when a cigar is positioned within the device, the device accommodating cigars of different lengths in the device while minimizing the overall length of the device.

13. The device of claim 12 wherein the adjusting means is a helical spring.

* * * * *

UNITED STATES PATENT AND TRADEMARK OFFICE

CERTIFICATE OF CORRECTION

PATENT NO. : 5,862,809

DATED : Jan. 26, 1999

INVENTOR(S) : Nicotra

It is certified that error appears in the above-identified patent and that said Letters Patent is hereby corrected as shown below:

In column 6, line 27, claim 1 after "of" delete "teh" and substitute therefor--the--

In column 8, line 1, after "snuffing" insert - - means having - -

Signed and Sealed this

Twenty-seventh Day of July, 1999

*Attest:*

Q. TODD DICKINSON

*Attesting Officer*

*Acting Commissioner of Patents and Trademarks*